United States Patent [19]

Sindoni

[11] Patent Number: 5,042,699

[45] Date of Patent: Aug. 27, 1991

[54] DISPENSER, IN PARTICULAR FOR PAINTS

[75] Inventor: Giuseppe Sindoni, Milan, Italy

[73] Assignee: Italtinto S.r.l., Carasco, Italy

[21] Appl. No.: 469,148

[22] Filed: Jan. 24, 1990

[30] Foreign Application Priority Data

Jan. 26, 1990 [IT] Italy ..... 2048/89[U]

[51] Int. Cl.[5] ..... B65D 47/00; B05B 15/02

[52] U.S. Cl. ..... 222/506; 222/148; 222/559; 239/114; 239/123; 239/69; 239/583

[58] Field of Search ..... 222/504, 506, 559, 545, 222/148, 325; 251/210; 239/123, 114, 115, 69, 574, 583

[56] References Cited

U.S. PATENT DOCUMENTS

| | | | |
|---|---|---|---|
| 3,463,363 | 8/1969 | Zelna | 222/504 |
| 3,521,853 | 7/1970 | Gillis, Jr. et al. | 251/210 |
| 3,580,435 | 5/1971 | Bertilsson | 222/504 |
| 4,231,547 | 11/1980 | Manfroni | 251/210 |
| 4,597,526 | 7/1986 | Egli et al. | 239/123 |
| 4,714,179 | 12/1987 | Otterstetter et al. | 239/112 |
| 4,801,051 | 1/1989 | Lewis et al. | 222/559 |
| 4,805,088 | 2/1989 | Cross et al. | 239/69 |

FOREIGN PATENT DOCUMENTS

| | | | |
|---|---|---|---|
| 2724931 | 2/1977 | Fed. Rep. of Germany | 239/123 |
| 2501859 | 9/1982 | France | 222/506 |

*Primary Examiner*—Andres Kashnikow
*Assistant Examiner*—Christopher G. Trainor
*Attorney, Agent, or Firm*—Notaro & Michalos

[57] ABSTRACT

A device for delivering paints comprises a housing containing a rod which is movable by a microprocessor controlled pneumatic piston, to seal both ends of a discharge duct. The pneumatic piston is activated to move the rod to open both ends of the discharge duct for the delivery of paint. The rod can then be moved to close the discharge duct and avoid the drying of paint within the duct.

10 Claims, 1 Drawing Sheet

DISPENSER, IN PARTICULAR FOR PAINTS

FIELD AND BACKGROUND OF THE INVENTION

The present invention relates to a dispenser for paints substantially consisting of a casing inside of which a pneumatic piston operates, to move a rod provided with a tip for regulating the delivery of the paint. The device according to the invention is particularly suitable for use in metering apparatuses such e.g., the one disclosed in the Italian Patent No. 1,101,604.

The characteristic feature of the invention is the particular shape and arrangement of the parts which make the use of this type much more practical of devices.

Dispensing systems are well known, such is paint dispensing machines including a duct for delivering the paint, said duct being connected to the metering apparatuses and sealed by means of a packing fixed to the stem of a pneumatic piston or other similar system.

These dispensers have, however, some inconveniences mainly due to the fact that the sealing means of the dispenser are places in an intermediate area of the discharge duct. This involving a certain lack of precision in the amount of the delivered material, part of which remains in the duct where. In the long run, this paint dries up, thus obstructing the duct.

This causes the need for frequent maintenance operations for cleaning the dispenser, these operations being complicated by the fact that in the presently known dispensers it is not possible to disassemble only their end portion for cleaning, so that rather costly interventions are needed.

SUMMARY OF THE INVENTION

In order to avoid such inconveniences the present invention discloses a dispenser wherein there are provided means suitable to hermetically seal from the outside the discharge duct and wherein the end portion of the dispenser, where this duct is placed, can be easily disassembled to make the cleaning easy, thus making the device substantially more practical.

In particular, the dispenser according to the invention includes a pneumatic piston the movements of which are controlled by means of a microprocessor, said piston moving a rod on which there is mounted a packing intended to hermetically seal the duct connecting the dispenser to the paint delivery devices. Moreover a blade is provided for, integral with said rod, suitable to seal the paint delivery opening so that, when the system is in the closing position, the paint left in the discharge duct is prevented from drying up.

The system is provided with a removable head where the discharge duct is placed, so that all the parts that are in touch with the paint can be easily and directly reached for a perfect and complete cleaning, by simply disassembling the head of the dispenser.

There are provided means, moved by springs, to assure the hermetic sealing of the system even in case the pneumatic force acting on the piston should fail for any reason.

DESCRIPTION OF THE PREFERRED EMBODIMENT

Figures 1, 2:
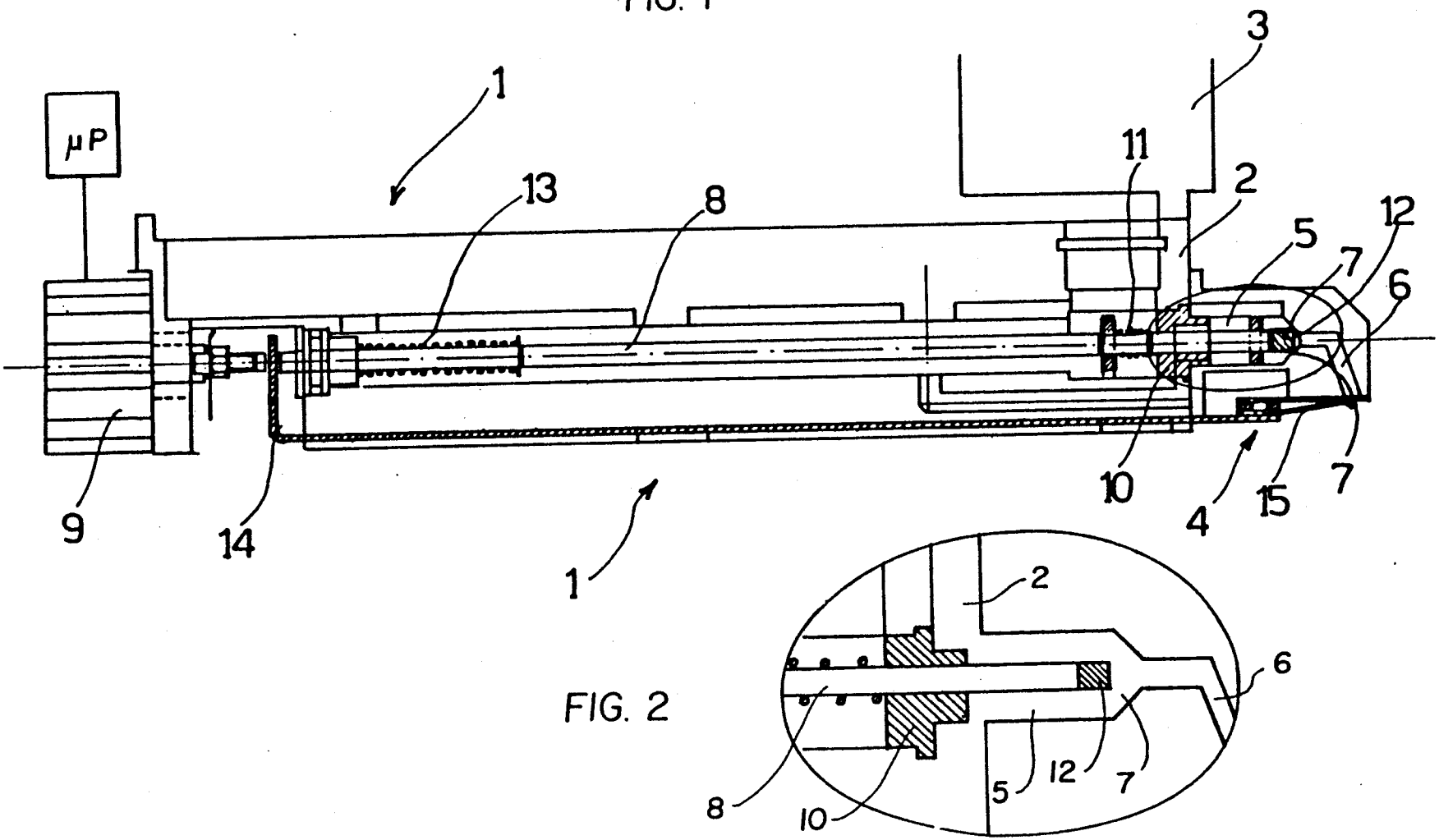
FIG. 1 is a schematic sectional view of the dispenser according to the invention shown in a closed position for the discharge duct.
FIG. 2 is a view of the circled area taken from FIG. 1, on an enlarged scale, showing the opened position for the discharge duct.

The present invention is now described in detail, with particular reference to the figures annexed hereto. FIG. 1 is a schematic, the section of a dispenser according to the invention.

The dispenser includes a body, generally designated 1, containing the adapting devices of the invention. Body 1 has a front head portion with, a duct 2 connected to an upwardly placed paint container 3.

The paint in the container passes from container 3 to duct 2.

An extrusion head, generally designated 4, is movably fastened to body 1. Inside the head 4 there is a substantially cylindrical chamber 5, communicating with duct 2 on one side thereof, and with a discharge duct 6 on the other.

At its front end, chamber 5 has inclined walls 7.

The rod 8 of a pneumatic piston 9, can slide inside body 1. Rod 8 carries a tip 10 which is mounted to slide along rod 8, and be pushed toward the front portion of the dispenser (toward the right in FIG. 1) by elastic means such as, e.g. a helicoidal spring 11. Piston 9 is controlled by a microprocessor 20 to move rod 8.

The shift of rod 8 is moved by piston 9 to move tip 10 from a position such as the one illustrated in the FIG. 1, where the tip leans against the wall of the dispenser, and blocks communication between chamber 5 and duct 2, to a second position, illustrated in FIG. 2, where it allows the free passage of the paint from the duct 2, to chamber 5.

At the front end of rod 8 there is a further sealing member 12 which, when the device is in the closing shown in FIG. 1, leans against the inclined walls 7, thus preventing any communication between an inlet end of discharge duct 6 and chamber 5. Rod 8 is also subjected to the action of a helicoidal spring 13 designated to push the rod to the right into the closing position of the device. A support 14 of a blade 15, e.g. made of steel, is fastened to rod 8 and shifts together with rod 8 for opening and closing, the, discharge duct 6 at its outside discharge end.

From the given specification the functioning of the device will be clear. To allow delivery of the paint from container 3, the pneumatic piston 9 is moved so as to move rod 8 to the left.

The head member 12 is disengaged from the inclined wall 7 and tip 10 withdrawns, allowing the paint to flow along duct 2 and from it to chamber 5 and to the discharge duct 6.

At the same time as rod 8, also support 14 of blade 15 shifts, and blade 15 allow allowing the paint to be discharged.

At the end of the discharge step the piston is moved again, taking the system back to the starting position, tip 10 thus sealing chamber 5, head member 12 leaning again against wall 7 and blade 15 sealing duct 6, stopping the delivery of paint.

In case of a missing or imprecise functioning of the pneumatic piston, spring 13 keeps rod 8 pressed in closing position of the dispenser.

As one can see from the specification, the invention teaches a delivery system for paints which is extremely precise as to the measure of the delivered paint and extremely practical and clean since, due to the action of blade 15, leaking of the paint after delivery is prevented and, at the same time, drying up of the paint in the delivery duct is avoided.

In case there is the need to clean the dispenser or to carry out maintenance operations, it is enough to remove head 4, to carry out such operations comfortably and in the most suitable conditions.

Obviously the sizes as well as the materials used can vary according to the use requirements.

I claim:

1. A paint delivering device, comprising:

a body;

a microprocessor-controlled piston connected to said body;

a rod connected to said piston for movement by said piston, said rod being slidably mounted to said body and having a closing tip and a sealing member spaced from said closing tip;

first means defining a paint delivering duct connected to said body for delivering paint, said paint delivering duct having an inlet end for receiving paint from a paint container, and an outlet end;

second means defining a paint delivering chamber said outlet end of said paint delivering duct being connected to one end of said chamber and said tip being movable into said one end of said chamber, and being shaped so that said outlet end of said paint delivering duct is opened and closed by said tip with movement of said rod for regulating a delivery of paint through said paint delivering duct into said chamber;

third means defining a discharge duct having an inlet end connected to an opposite end of said chamber, and a discharge end; and a blade connected to said rod for movement with said rod, said blade being positioned for movement across said discharge end for cutting excess paint from said discharge end and for sealing said discharge end when said tip is in a position closing said paint delivering duct;

said sealing member being movable with said rod in said chamber for opening and closing said inlet end of said of said discharge duct with movement of said rod, said sealing member opening and closing said inlet end of said discharge chamber as said tip opens and closes said outlet end of said paint delivering duct.

2. A device according to claim 1, wherein said first, second and third means comprise a head carrying said paint delivering duct, said paint delivering chamber and said discharge duct, said head being removably mounted to said body whereby said head is removed from said body for cleaning paint from said paint delivering duct, said chamber and said discharge duct.

3. A device according to claim 2, wherein said tip is slidably mounted to said rod, said device including biasing means engaged with said rod and said tip for biasing said tip in a direction for closing said outlet end of said paint delivering duct.

4. A paint delivering device, comprising:

a body;

a piston mounted for movement to said body;

a rod connected to said piston for movement by said piston, said rod being slidably mounted to said body and having a closing tip and a sealing member spaced from said closing tip;

first means defining a paint delivering duct connected to said body for delivering paint, said paint delivering duct having an inlet end for receiving paint from a paint container, and an outlet end;

second means defining a paint delivering chamber, said outlet end of said paint delivering duct being connected to one end of said chamber and said tip being movable into said one end of said chamber, and being shaped so that said outlet end of said paint delivering duct is opened and closed by said tip with movement of said rod for regulating a delivery of paint through said paint delivering duct into said chamber;

third means defining a discharge duct having an inlet end connected to an opposite end of said chamber, and a discharge end; and a blade connected to said rod for movement with said rod, said blade being positioned for movement across said discharge end for cutting excess paint from said discharge end and for sealing said discharge end when said tip is in a position closing said paint delivering duct;

said sealing member being movable with said rod in said chamber for opening and closing said inlet end of said·of said discharge duct with movement of said rod, said sealing member opening and closing said inlet end of said discharge chamber as said tip opens and closes said outlet end of said paint delivering duct.

5. A device according to claim 4, wherein said piston comprises a pneumatic piston.

6. A device according to claim 5, wherein said first, second and third means comprise a head carrying said paint delivering duct, said paint delivering chamber and said discharge duct, said head being removably mounted to said body whereby said head is removed from said body for cleaning paint from said paint delivering duct, said chamber and said discharge duct.

7. A device according to claim 6, wherein said tip is slidably mounted to said rod, said device including biasing means engaged with said rod and said tip for biasing said tip in a direction for closing said outlet end of said paint delivering duct.

8. A device according to claim 4 wherein said chamber includes inclined walls at said opposite end of said chamber adjacent said discharge duct, said sealing member being engagable against said inclined walls for closing said inlet end of said discharge duct.

9. A device according to claim 4, including biasing means connected to said rod for biasing said rod in a direction to close said discharge end with said blade.

10. A device according to claim 6, wherein said body slidably receives said rod, said pneumatic piston being mounted on said body on an end of said body opposite from said head, said tip being slidably mounted to said rod, a first spring connected between said rod and said tip for biasing said tip into a position closing said outlet end of said paint delivering duct, and a second spring engaged between said body and said rod for biasing said blade into a position closing said discharge end of said discharge duct.

* * * * *